US010676949B2

(12) United States Patent
Dershem

(10) Patent No.: US 10,676,949 B2
(45) **Date of Patent: *Jun. 9, 2020**

(54) POOL COVER SPRING AND METHOD OF USE

(71) Applicants: Jeffrey L. Dershem, Zionsville, PA (US); Deborah L. Dershem, Zionsville, PA (US)

(72) Inventor: Jeffrey L. Dershem, Zionsville, PA (US)

(73) Assignees: Jeffrey L. Dershem, Zionsville, PA (US); Deborah L. Dershem, Zionsville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/095,436

(22) PCT Filed: Apr. 19, 2017

(86) PCT No.: PCT/US2017/028305

§ 371 (c)(1),
(2) Date: Oct. 22, 2018

(87) PCT Pub. No.: WO2017/184698

PCT Pub. Date: Oct. 26, 2017

(65) Prior Publication Data

US 2019/0136559 A1 May 9, 2019

Related U.S. Application Data

(63) Continuation-in-part of application No. 15/134,589, filed on Apr. 21, 2016, now Pat. No. 10,253,516.

(51) Int. Cl.
*E04H 4/14* (2006.01)
*E04H 4/06* (2006.01)

(52) U.S. Cl.
CPC ..... *E04H 4/14* (2013.01); *E04H 4/06* (2013.01)

(58) Field of Classification Search
CPC ..... E04H 4/14; E04H 4/06
USPC ..... 4/503
See application file for complete search history.

(56) References Cited

U.S. PATENT DOCUMENTS

| | | | | |
|---|---|---|---|---|
| 3,653,652 | A | 4/1972 | Lindberg, Jr. | |
| 5,014,369 | A * | 5/1991 | Daus | E04H 4/10 4/503 |
| 5,800,089 | A | 9/1998 | Donaton | |
| 10,253,516 | B2 * | 4/2019 | Dershem | E04H 4/14 |
| 2009/0100646 | A1 * | 4/2009 | Wang | F16B 45/00 24/265 H |
| 2010/0135024 | A1 * | 6/2010 | Gier | F21V 3/02 362/294 |
| 2012/0278987 | A1 | 11/2012 | Marelli | |
| 2015/0074953 | A1 | 3/2015 | Dershem | |

* cited by examiner

*Primary Examiner* — Tuan N Nguyen
(74) *Attorney, Agent, or Firm* — Clark & Brody LP

(57) ABSTRACT

A pool cover spring includes a one piece molded spring body having a narrowed midsection, an end with a connector for attaching to a pool deck anchor and another end with slots for receiving a strap of a pool cover.

12 Claims, 5 Drawing Sheets

POOL COVER SPRING AND METHOD OF USE

FIELD OF THE INVENTION

The present invention is directed to a pool cover spring and, in particular, to a one piece molded body having ends respectively configured to attach to a pool deck anchor and straps from a pool cover.

BACKGROUND ART

Pool cover springs are well known in the pool industry. These springs use a metallic bent wire spring mechanism, one end configured to connect to an anchor on a pool deck and the other end configured to connect to a strap of a pool cover. These springs are expensive, can cause a tripping hazard when walking on the pool deck, and can cause physical marring damage to the pool deck during spring activation.

SUMMARY OF THE INVENTION

It is a first object of the invention to provide an improved pool cover spring with simple method of use and made of a material(s) that will not cause physical marring damage to the pool deck; and will withstand environmental exposure.

A further object of the invention to provide a pool cover spring that has a low profile, is inexpensive to make, and optionally can be made to glow in the dark to avoid tripping.

One embodiment of the invention includes a spring body that has a first end, second end, and mid-section between the first and second ends. The second end includes a plurality of slots transversely configured with respect to a longitudinal direction of the spring body to receive a strap of a pool cover. The midsection has a cross section smaller than the first and second ends. The spring body is a one piece molded body with the plurality of slots molded into the spring body.

A connector is also included and associated with the first end. The connector is designed to attach to an anchor of a pool deck. The connector is integrally molded into the first end of the spring body. The connector can be any type of a structure that creates an opening to receive the pool deck anchor and examples include a ring, e.g., a d-ring, a circular ring and the like.

In one embodiment, the spring body can be made so that it has glow in the dark capability.

While any molding can be used to make the spring body, injection molding is preferred.

Exemplary materials to be molded into the spring body could include elastomeric compounds of gum rubber, epdm rubber, silicone, silicone vulcanate, thermal cast urethane and extruded/injection molded-thermal plastic urethane.

The pool spring cover can also be molded with a flat underside surface to facilitate it resting on a flat pool deck. The spring body can be molded with a solid construction or molded with cavities in, the cavities formed in an underside of the spring body for material savings. The cavities can be formed by ridges that extend longitudinally, transversely, and obliquely in the ends to enhance strength thereof and formed by ridges running longitudinally along the spring body to enhance the stretching of the mid-section during use.

The invention also includes a method of attaching straps of a pool cover to anchors in a pool deck, the improvement comprising using the pool cover spring of claim 1 and attaching the connector to the anchor and the strap to the slots in the second end of the spring body and tensioning the pool cover spring to keep the pool cover in place.

The inventive pool cover spring can also include an insert on the slot-containing end and/or on the connector-containing end to add strength and focus the stretching of the pool cover spring in its midsection rather than in one or both of the ends having the slots and connector.

BRIEF DESCRIPTION OF THE DRAWINGS

Reference is now made to the drawings of the invention wherein.

DESCRIPTION OF THE PREFERRED EMBODIMENTS

Figure 1:
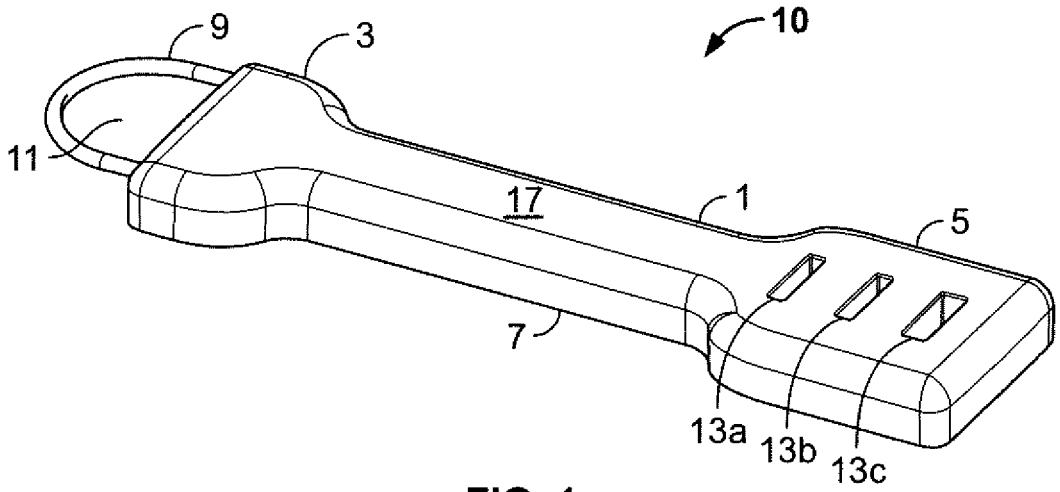
FIG. 1 is shows a top perspective view of one embodiment of the inventive pool cover spring.
Figure 2:
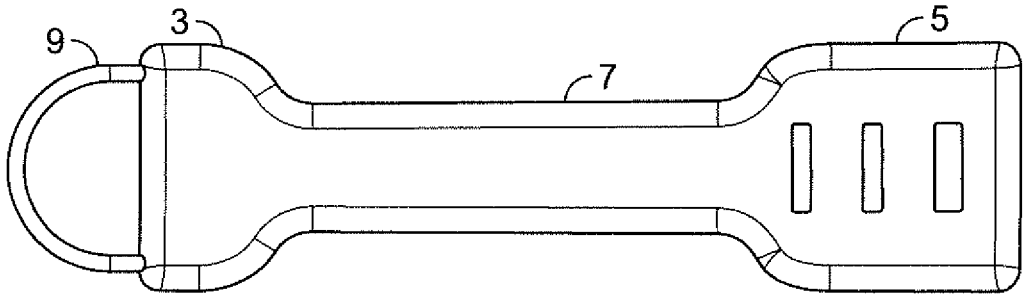
FIG. 2 shows a top plan view of the pool cover spring of FIG. 1.

The invention provides an improved pool cover spring. The pool cover spring is inexpensive to make and has a low profile to minimize tripping and made of materials as to not cause physical marring damage to the pool deck.

Referring to FIGS. 1-5, one embodiment of the pool spring cover is designated by the reference numeral 10. The pool spring cover 10 has a spring body 1, the body 1 having a pair of opposing ends 3 and 5 that are connected together with a reduced size midsection 7. The end 3 includes a molded-in connector 9, which is a d-ring in this embodiment. The connector 9 forms an opening 11 with the end 3 that is sized to hook onto a pool deck anchor (not shown). While a d-ring 9 is shown, any type of connector could be used that would be able to be securely attached to the anchor on a pool deck, a hook, a circular ring, or the like and be molded with the spring body 1.

The other end 5 of the spring body 1 has a plurality of slots 13*a*, 13*b*, and 13*c* running transverse to a longitudinal direction of the spring body 1. The slots 13*a-c* are spaced apart and sized to receive the strap of a pool cover. The strap passes through the slots 13*a-c* and is pulled/length adjusted to tension the pool cover. At least three slots 13*a-c* are needed to assist in connecting the strap to the spring 10 in order to alleviate an additional metal buckle currently required when using the traditional bent metal spring and is instrumental in accommodating streamlining the pool cover strapping by allowing for the insertion of the tag end of the strap into the double wide third slot 13*c*; the embodiment of FIG. 1 shows the three slots 13*a-c*. If the pool cover spring is used with a strap using the conventional metal buckle, two slots could be used.

The midsection 7 is made with a smaller cross section than either of the ends 3 and 5 so that the midsection 7 will preferentially stretch once the pool cover spring 10 is attached between a pool cover and an anchor and tensioned.

The spring body 1 can be made by molding it into a one-piece part. The connector 9 is a metal material and is integrally molded into the spring body 1 during the molding process.

The material of the spring can be any type of a moldable and elastic material. Examples include elastomeric compounds of gum rubber, epdm rubber, silicone, silicone vulcanate, thermal cast urethane and extruded/injection molded-thermal plastic urethane.

The molding process can be any known process, with injection molding or thermal cast molding being preferred.

Figure 3:
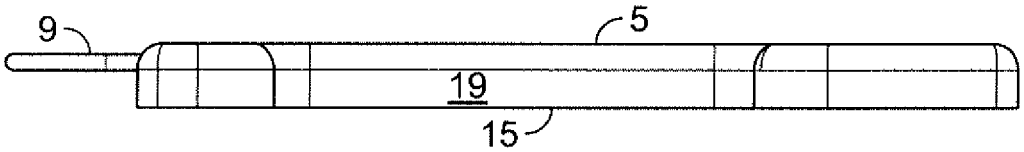
FIG. 3 shows a side view of the pool cover spring of FIG. 1.

In the embodiment of FIGS. 1-6, the spring body 1 is made so that an underside 15, see FIG. 3, can lay flat on a flat surface such as a pool deck.

Referring to FIGS. 1 and 3, the spring body 1 can be molded with solid surfaces 17 and 19 for the top and sides.

Figure 4:
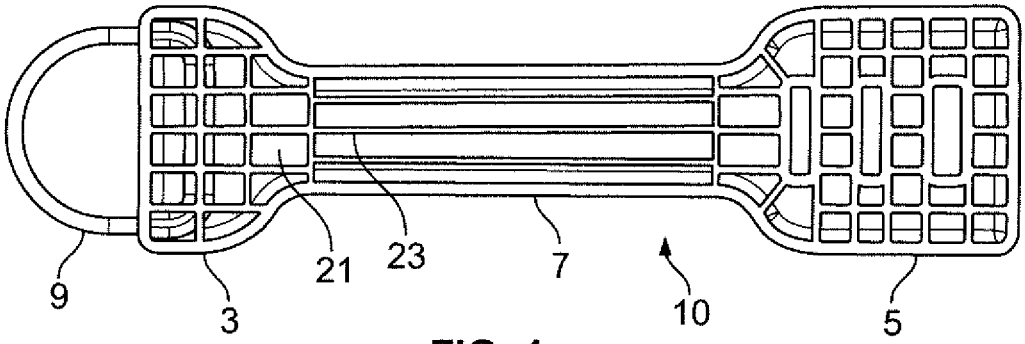
FIG. 4 is a bottom view of the pool cover spring of FIG. 1.
Figure 5:
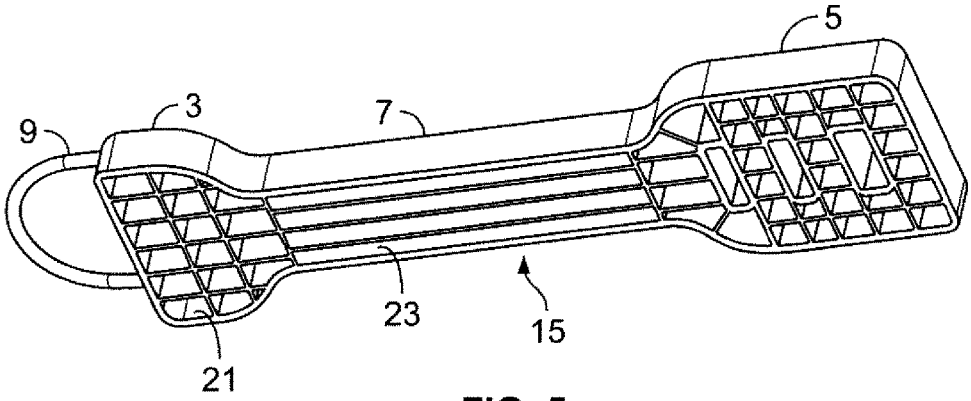
FIG. 5 is a bottom perspective view of the pool cover spring of FIG. 1.

Referring to FIGS. 4 and 5, the spring body 1 is molded with the underside 15 comprising a number of cavities 21 and ridges 23. The ridges 23 run transversely, longitudinally, and obliquely and interconnect to form the various cavities 21 in the underside 15 of the spring body 1. The cavities 21 perform a material savings function for the molding process and/or could be alleviated for a solid molded part. The ridges 23 in the midsection 7 run longitudinally to assist in the stretching that the midsection sees when the pool cover spring 10 is tensioned. The ridges 23 in the ends 3 and 5 run longitudinally, obliquely, and transversely to provide the ends 3 and 5 with more rigidity and less elasticity so as to handle the connection to the anchor and pool cover strap.

Figure 6:
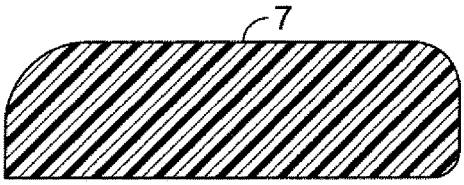
FIG. 6 is a cross sectional view along a midsection of a second embodiment of the pool cover spring.

The spring body 1 can be molded either as a solid piece or one that has cavities on the underside for the benefits noted above. The top surface 17 could also be molded in a non-smooth surface for aesthetic effect or to enhance gripping. FIG. 6 shows a cross sectional view along the midsection 7 of a spring body that is molded in a solid configuration.

The spring body 1 can be molded with glow in the dark compounds so that the pool cover spring 10 can be more easily seen at nighttime and becomes less of a tripping hazard. As the compounds and the technique of incorporating them into molded components are well known, a further description of this aspect of the invention is not necessary for understanding of the invention. The spring body 1 can also be molded in different colors as well.

Figure 7:
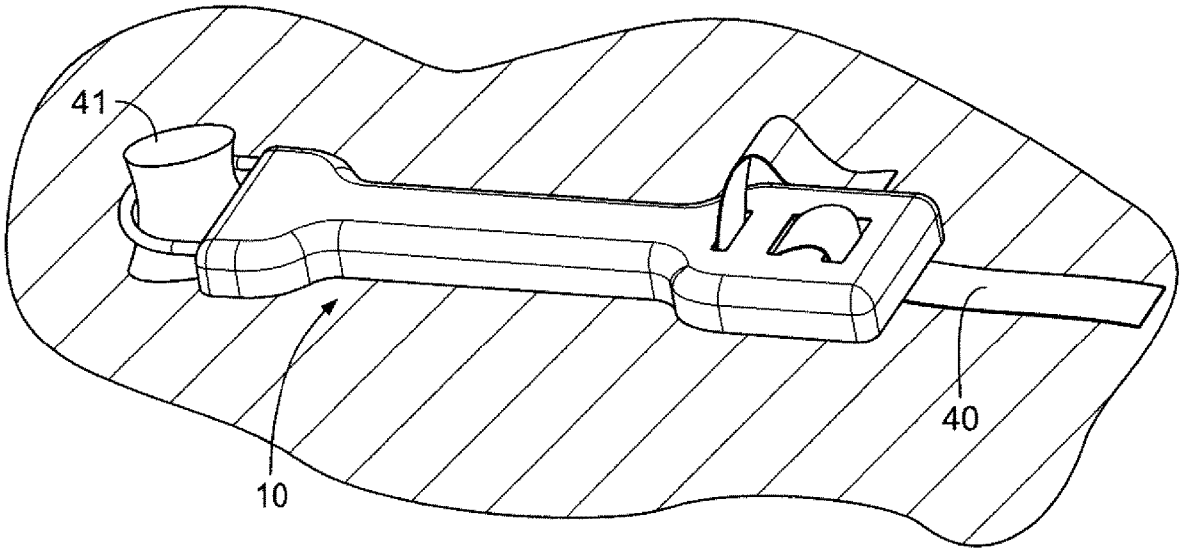
FIG. 7 shows the pool spring cover engaged with a pool deck anchor and pool cover strap.

In use, strategically placed around the entire perimeter of the pool cover and with reference to FIG. 7, a strap 40 from a pool cover (not shown) is first threaded through the slots 13 to the extent that the pool cover spring 10 is close to but not able to have the connector 9 slip over an anchor 41 of a pool deck. The pool spring is attached to the pool deck anchor 41 by sliding the connector 9 onto a conventional notched end lever-arm pipe, the lever-arm pipe is then placed over the pool deck anchor post 41 and the lever-arm pipe is levered toward the anchor post 41 to activate (stretch) the pool cover spring, thus lengthening the pool cover spring as the connector 9 is slid down the lever-arm pipe and over the anchor post 41. Repeating this process around the perimeter of the pool cover tensions the cover in place. To remove, the anchor 41 can be removed from the pool deck so as to release the tension or the notched lever-arm pipe maybe use in the reverse manner of attachment.

Alternatively, the connector 9 can be first slipped onto an anchor and then the strap 40 is attached to the spring body end 5 and pulled to tension the pool cover spring. Another mode of use would be to attach the connector to the anchor while the strap is attached to the end 5 and then tension the pool cover spring.

Figure 8:
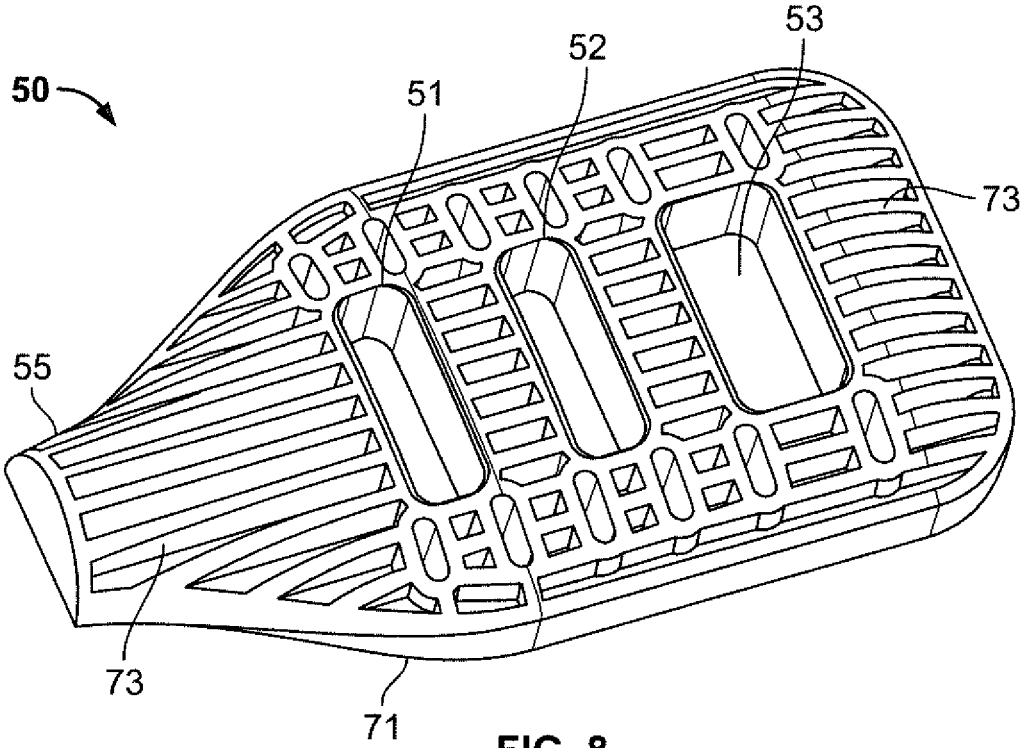
FIG. 8 shows an example of an insert to be molded into end of the pool cover spring having the slots therein.
Figure 9:
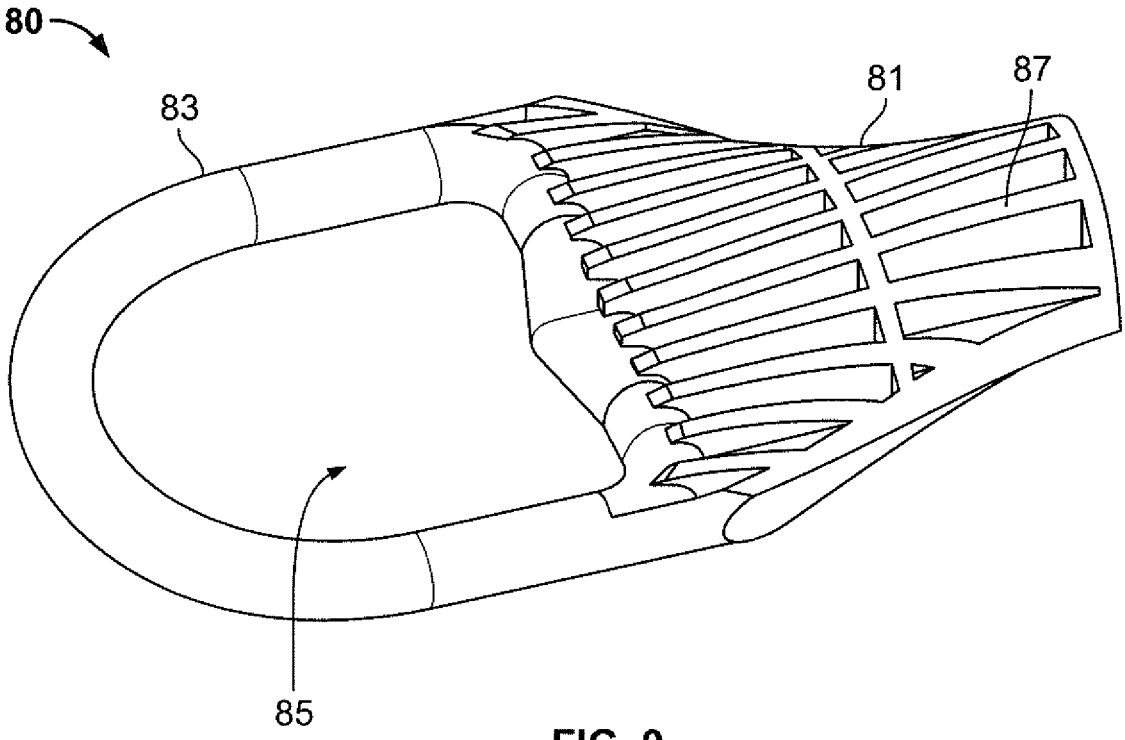
FIG. 9 shows an example of an insert to be molded into the end of the pool cover spring opposite the one with the slots therein.
Figure 10:
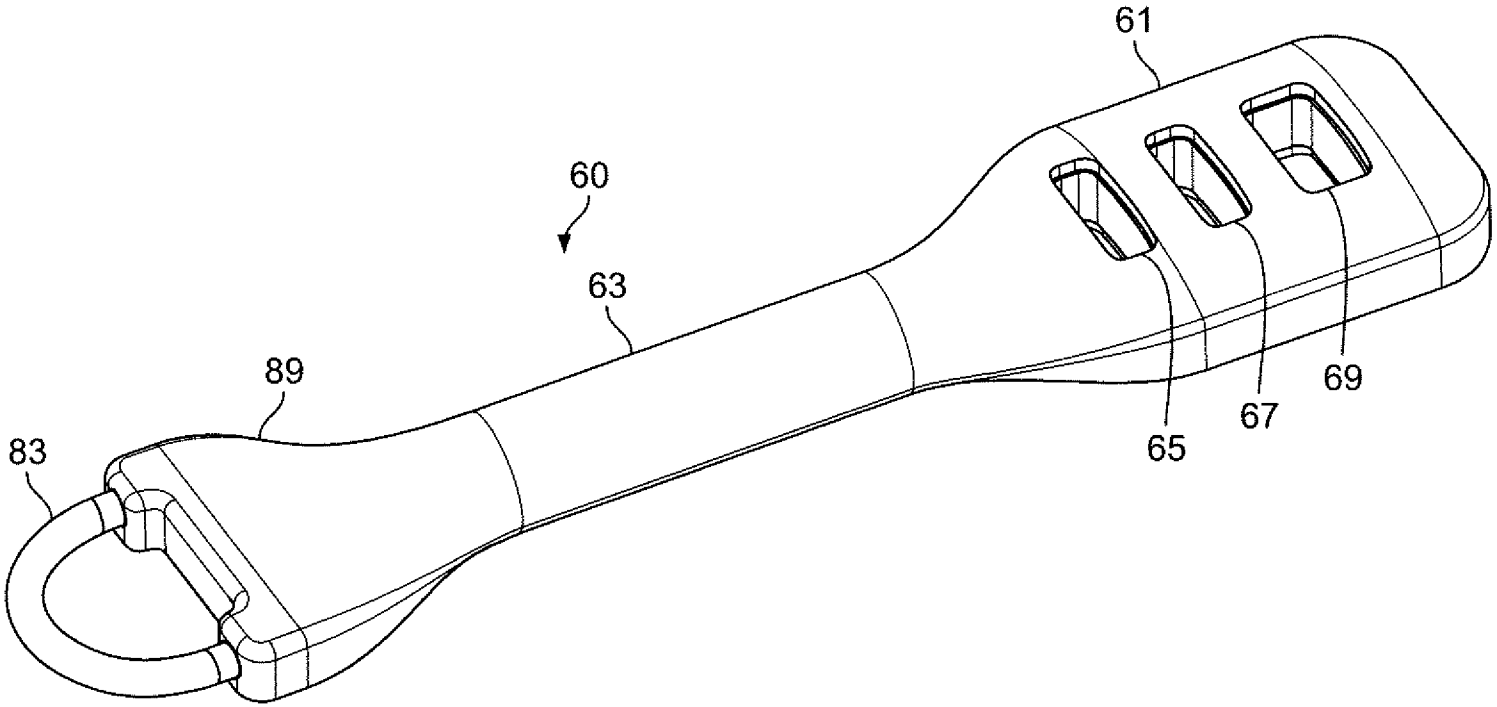
FIG. 10 shows a pool cover spring using the inserts of FIGS. 8 and 9.

Another embodiment of the invention is disclosed in FIGS. 8-10. In FIG. 8, a ladder-like insert 50 is provided. The insert 50 has slots 51, 52, and 53 and a narrowed section 55. The insert 50 is designed to be used during the molding of the pool cover spring 60 shown in FIG. 10. That is, the insert 50 with the narrowed section 55 and slots 51-53 acts as a core of the end 61 of the pool cover spring 60 with material molded around it, including around its periphery and the slots 51-53. The slots 51-53 are designed so that the same configuration is produced for the slots 13*a*-13*c* shown in FIG. 1. The insert provides added strength to the end 61 and prevents the slots 65, 67, and 69 in the finally molded pool cover spring 60 from being distorted and stretching when the pool cover spring 60 is being used. By strengthening the end 61 using the insert 50, the stretching of the pool cover spring 60 occurs in the midsection 63.

The insert can be made of any material but a preferred material can include a fiber-reinforced nylon or similar polymer that would have equivalent strength. Other materials such as cast metals or a formed wire configuration could also be employed. If using a material that can be molded for the insert, the insert is preferably molded as a one piece insert.

The insert 50 can be made with a periphery 71 and a number of ribs 73 positioned throughout the insert for strengthening purposes. This configuration is just an example of the shape of the insert 50 and other rib patterns could be used. In addition, the insert 50 could be molded or made as a solid piece as well.

FIG. 9 shows another insert 80 designed for the connector end 89 of the spring shown in FIG. 10. The insert 80 includes an insert body 81 and a ring portion 83 that extends from the body 81 to create a space 85. Similar to the insert 50, the insert body 81 can be molded with ribs 87 for strengthening purposes. As with the insert 50 in FIG. 8, the insert 80 can be formed or molded/made with different rib configurations or into a solid one-piece configuration.

The insert body 81 also includes a narrowed portion 89, similar to the narrowed portion 55 of the insert 50. The narrowed portion 89 is designed to extend into the midsection 63 of the spring 60.

The insert 80 is then molded into the pool cover spring 60 in the same manner as described above for the insert 50. The molding of the insert 80 is such that the ring portion 83 extends from the end 89 to allow connection when securing a pool cover, similar to the manner of attachment shown in FIG. 7.

Either one or both inserts 50 and 80 could be used with the pool spring cover. The inserts add strength and stiffness to the ends 61 and 89 of the pool cover spring 60. What this does is then make the midsection 63 preferentially stretch when the pool cover spring is used and reduce any distortion that could occur to either end 61 or 89 when the pool cover spring is tensioned in place.

As such, an invention has been disclosed in terms of preferred embodiments thereof which fulfills each and every one of the objects of the present invention as set forth above and provides a new and improved pool cover spring and method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A pool cover spring comprising:

a spring body, the spring body further comprising a first end, a second end including a plurality of slots transversely configured with respect to a longitudinal direction of the spring body to receive a strap of a pool cover; and a midsection extending between the first and second ends, the midsection having a cross section smaller than the first and second ends; wherein the spring body is a one piece molded body with the plurality of slots in the second end molded into the spring body; and a connector configured to attach to an anchor of a pool deck and integrally molded into the first end of the spring body.

2. The pool cover spring of claim 1, wherein the spring body has glow in the dark capability.

3. The pool cover spring of claim 1, wherein the connector is a ring.

4. The pool cover spring of claim 1, wherein the spring body is made by injection or thermal cast molding.

5. The pool cover spring of claim 1, wherein the spring body is made from elastomeric compounds selected from the group consisting of gum rubber, epdm rubber, silicone, silicone vulcanate, thermal cast urethane and extruded or injection molded-thermal plastic urethane.

6. The pool cover spring of claim 1, wherein the spring body has a flat underside surface.

7. The pool cover spring of claim 6, wherein the spring body further comprises a plurality of cavities in the flat underside surface of the spring body.

8. The pool cover spring of claim 1, wherein the connector extends from an end face of the first end of the spring body, the connector and end face forming a space to receive the anchor.

9. In a method of attaching straps of a pool cover to anchors in a pool deck, the improvement comprising using the pool cover spring comprising:

a spring body, the spring body further comprising a first end, a second end including a plurality of slots transversely configured with respect to a longitudinal direction of the spring body to receive a strap of a pool cover; and a midsection extending between the first and second ends, the midsection having a cross section smaller than the first and second ends; wherein the spring body is a one piece molded body with the plurality of slots in the second end molded into the spring body; and a connector configured to attach to an anchor of a pool deck and integrally molded into the first end of the spring body and attaching the connector to one of the anchors and one of the straps to the slots in the second end of the spring body and tensioning the pool cover spring to keep the pool cover in place.

10. A pool cover spring comprising:

a spring body, the spring body further comprising a first end, a second end including a plurality of slots transversely configured with respect to a longitudinal direction of the spring body to receive a strap of a pool cover; and a midsection extending between the first and second ends, the midsection having a cross section smaller than the first and second ends; wherein the spring body is a one piece molded body with the plurality of slots in the second end molded into the spring body; and a connector configured to attach to an anchor of a pool deck and integrally molded into the first end of the spring body, the pool cover spring further comprising a first insert containing a plurality of insert slots, the first insert molded into the second end so that the slots of the second end are aligned within the insert slots of the first insert.

11. The pool cover spring of claim 10, further comprising a second insert, the second insert including a ring portion that functions as the connector, the second insert molded into the first end with the ring portion extending from the first end.

12. A pool cover spring comprising:

a spring body, the spring body further comprising a first end, a second end including a plurality of slots transversely configured with respect to a longitudinal direction of the spring body to receive a strap of a pool cover; and a midsection extending between the first and second ends, the midsection having a cross section smaller than the first and second ends; wherein the spring body is a one piece molded body with the plurality of slots in the second end molded into the spring body; and a connector configured to attach to an anchor of a pool deck and integrally molded into the first end of the spring body, the pool cover spring further comprising a second insert, the second insert including a ring portion that functions as the connector, the second insert molded into the first end with the ring portion extending from the first end.

* * * * *